US005195199A

United States Patent [19]

Sereboff

[11] Patent Number: 5,195,199

[45] Date of Patent: * Mar. 23, 1993

[54] FLUID CUSHION

[76] Inventor: Joel L. Sereboff, 2215 Millridge Rd., Owings Mills, Md. 21117

[ * ] Notice: The portion of the term of this patent subsequent to May 19, 2009 has been disclaimed.

[21] Appl. No.: 884,164

[22] Filed: May 18, 1992

Related U.S. Application Data

[63] Continuation-in-part of Ser. No. 725,512, Jul. 3, 1991, Pat. No. 5,113,540.

[51] Int. Cl.[5] ..... A47C 27/08; A61G 7/057

[52] U.S. Cl. ..... 5/654; 5/455; 5/909

[58] Field of Search ..... 5/654, 451, 455, 449, 5/450, 458, 457, 452, 909; 297/DIG. 3, 459; D6/604

[56] References Cited

U.S. PATENT DOCUMENTS

| | | | |
|---|---|---|---|
| 180,528 | 8/1876 | Boggett | 5/458 |
| 187,397 | 2/1877 | MacIntosh et al. | 5/458 |
| D. 284,139 | 6/1986 | Ko | 5/654 |
| 1,673,636 | 6/1928 | Perry | 297/DIG. 3 |
| 1,830,570 | 11/1931 | Smith et al. | 5/654 |
| 2,604,641 | 7/1952 | Reed | 5/455 |
| 2,625,209 | 1/1953 | Harrison et al. | 297/DIG. 3 |
| 4,389,742 | 6/1983 | DeWitt | 5/654 |
| 4,688,284 | 8/1987 | Wride et al. | 5/921 |
| 4,766,629 | 8/1988 | Schueler | 5/455 |
| 4,942,634 | 7/1990 | Saloff et al. | 5/450 |
| 5,044,030 | 9/1991 | Balaton | 5/455 |
| 5,113,540 | 5/1992 | Sereboff | 5/654 |

FOREIGN PATENT DOCUMENTS

| | | | |
|---|---|---|---|
| 19985 | of 1897 | United Kingdom | 5/458 |

*Primary Examiner*—Alexander Grosz

*Attorney, Agent, or Firm*—Morton J. Rosenberg; David I. Klein

[57] ABSTRACT

This invention provides for a fluid cushion (10) defined by a fluid tight closed housing (22) which is deformable by applied load of a user (12). The fluid cushion (10) includes an upper surface member (24), a lower surface member (26) and an intermediate membrane (64) which divides the interior of the housing (22) into a first fluid medium containing chamber (62) and a second fluid medium containing chamber (60). A tubular mechanism (42) defines through passages (46) which are positionally located for insertion therein of particular bones of the human body. The tubular mechanism (42) has tubular sidewall members (50) which are contoured to provide an apex (52) at a substantially central location between the upper surface member (24) and the lower surface member (26) and allows for maintenance of the fluid mediums (21 and 20) within spaces (48) between openings (32 and 34). In this manner, a resilient, flexible, and deformable fluid cushion (10) is provided for a user (12) to relieve particular discomforting applied loads to the ischia spine bones of the user (12).

21 Claims, 3 Drawing Sheets

FLUID CUSHION

REFERENCE TO RELATED PATENT APPLICATIONS

This patent application is a continuation-in-part of U.S. patent application Ser. No. 07/725,512 filed Jul. 3 1991, issued as U.S. Pat. No. 5,113,540 on May 19, 1992.

BACKGROUND OF THE INVENTION

1. Field of the Invention

This invention pertains to a flexible and deformable fluid cushion to alleviate discomfort to a user due to excessive force loading on the user's ischial spines. In particular, this invention relates to a resilient, flexible and deformable fluid cushion which allows the user to sit on a base surface for prolonged periods of time with a minimization of discomfort and a minimized possibility of forming decubitus ulcers. More in particular, this invention directs itself to a fluid tight deformable fluid cushion defined by a closed housing having an upper surface member and a lower surface member joined each to the other for the purpose of containing a fluid medium therein. Still further, this invention relates to a fluid tight deformable fluid cushion housing having an intermediate plastic membrane dividing the interior of the housing into a first chamber and a second chamber containing therein first and second fluid mediums. Additionally, this invention relates to a fluid cushion having a pair of independent and isolated fluid chambers containing fluids of differing viscosities which lower the discomfort level of the user during prolonged periods of sitting. Still further, this invention directs itself to a deformable fluid cushion having a pair of through passages aligned in the neighborhood of the ischial spines of a user. This invention directs itself to a deformable fluid cushion where a tubular mechanism having sidewalls defines the through passages aligned with the ischial spines of a user. Further, this invention relates to a tubular mechanism having the sidewalls of varying cross-sectional diameters as a function of the vertical distance between the upper and lower surface members forming the fluid tight closed housing. More in particular, this invention directs itself to a tubular mechanism defining the through passages aligned with the ischial spines of the user wherein the through passages have an apex diameter substantially at the midpoint between an undeformed distance between the upper and lower surface members of the fluid tight closed housing. More in particular, this invention relates to a housing having tubular mechanisms which are sealed to an intermediate membrane layer or member dividing the interior of the fluid cushion into two independent fluid containing chambers. Still further, this invention directs itself to a deformable and resilient fluid cushion containing two fluid mediums where there is provided a wave damping mechanism within one of the internal chambers defined by the upper and lower surface members and the intermediate membrane layer member.

2. Prior Art

Deformable fluid cushions are known in the art. However, fluid cushions having particularly contoured and sized openings for interface with the ischial spines of a person for relief of discomfort in those particular user areas is not known to the Applicant.

The best prior art known to Applicant includes U.S. Pat. Nos. 180,528; 187,397; 4,766,629; 1,830,570; 1,673,636; 2,625,209; and, United Kingdom Patent

#19985. However, none of these references provide for the overall fluid tight closed housing having a lower surface and upper surface members sandwiching an intermediate membrane member defining a pair of chambers for containing liquids of differing viscosity as is herein described. Additionally, none of these references are believed to provide for tubular mechanisms having tubular sidewalls with varying cross-sectional diameters when taken with respect to a vertical direction as is necessary to the subject invention concept.

SUMMARY OF THE INVENTION

A fluid cushion is provided which includes a fluid tight closed housing having an upper surface member, a lower surface member and an intermediate membrane member. A combination of these elements define an internal fluid tight housing first chamber and an internal fluid tight housing second chamber. The first chamber has a first fluid medium contained therein and the second chamber has a respective second fluid medium contained therein. A tubular mechanism is provided which is secured to the upper surface member, the lower surface member and the intermediate membrane member in fluid tight relation. The tubular mechanism defines at least one vertically directed through opening having tubular sidewall members of varying cross-sectional diameter when taken with respect to a vertical direction.

DESCRIPTION OF THE PREFERRED EMBODIMENTS

Figure 1:
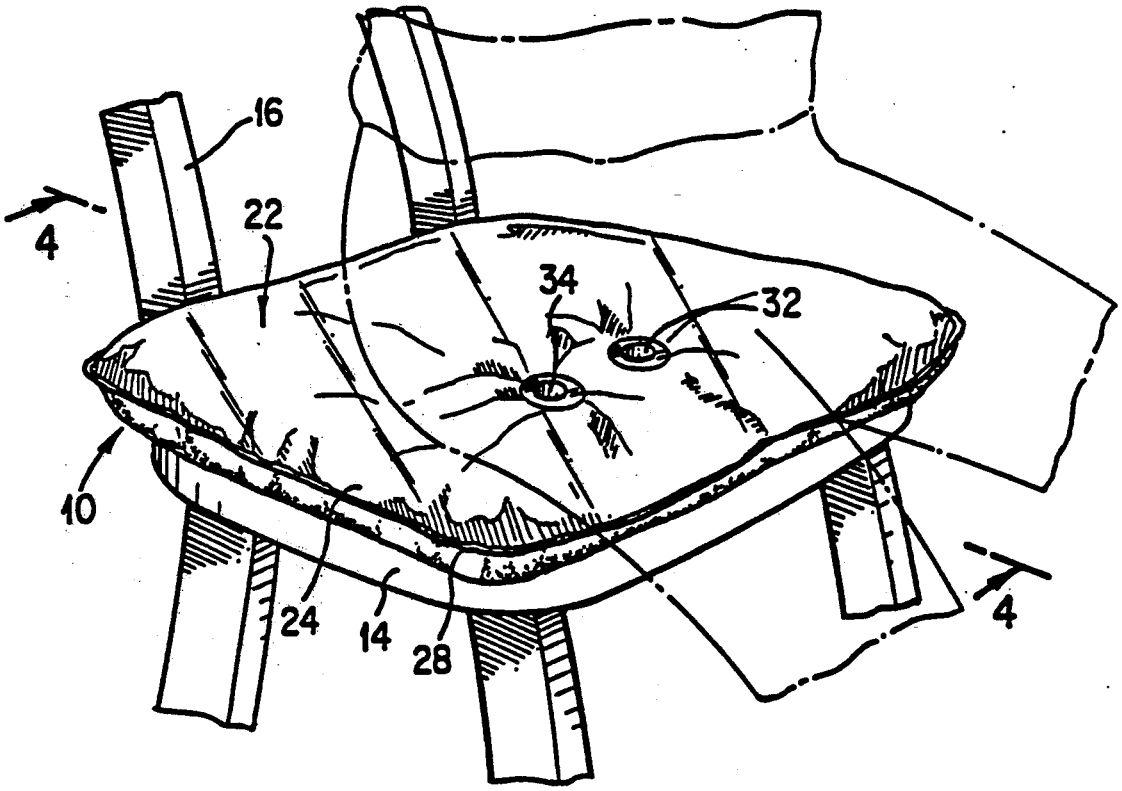
FIG. 1 is a perspective view of the fluid cushion of the invention concept placed on a base surface.
Figure 2:
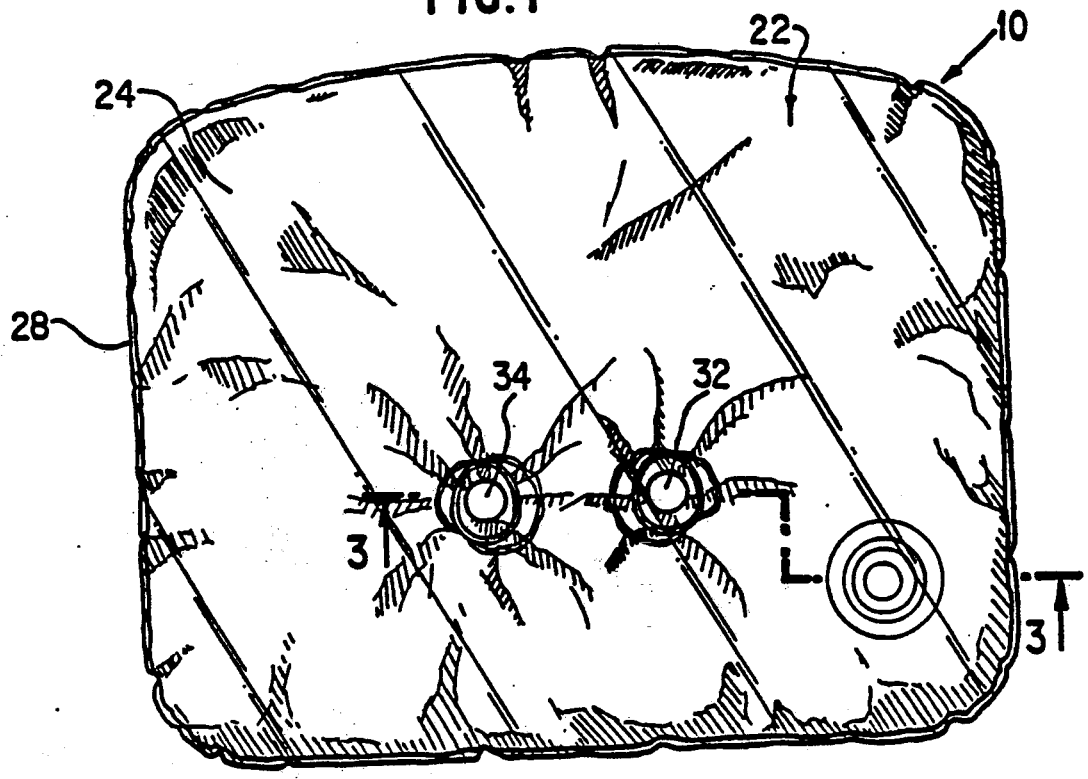
FIG. 2 is a plan view of the fluid cushion of the subject invention concept.
Figure 3:
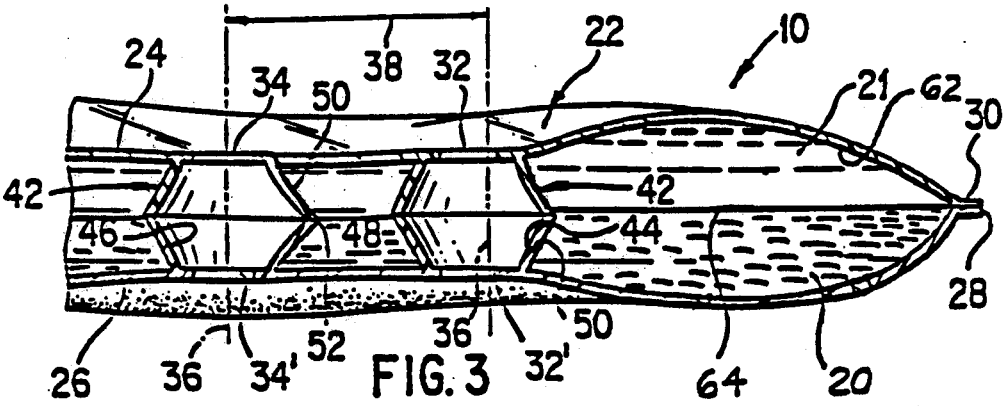
FIG. 3 is a cross-sectional view of the fluid cushion taken along the section lines 3—3 of FIG. 2 showing the intermediate membrane member and the resulting fluid containing first and second internal chambers.
Figure 4:
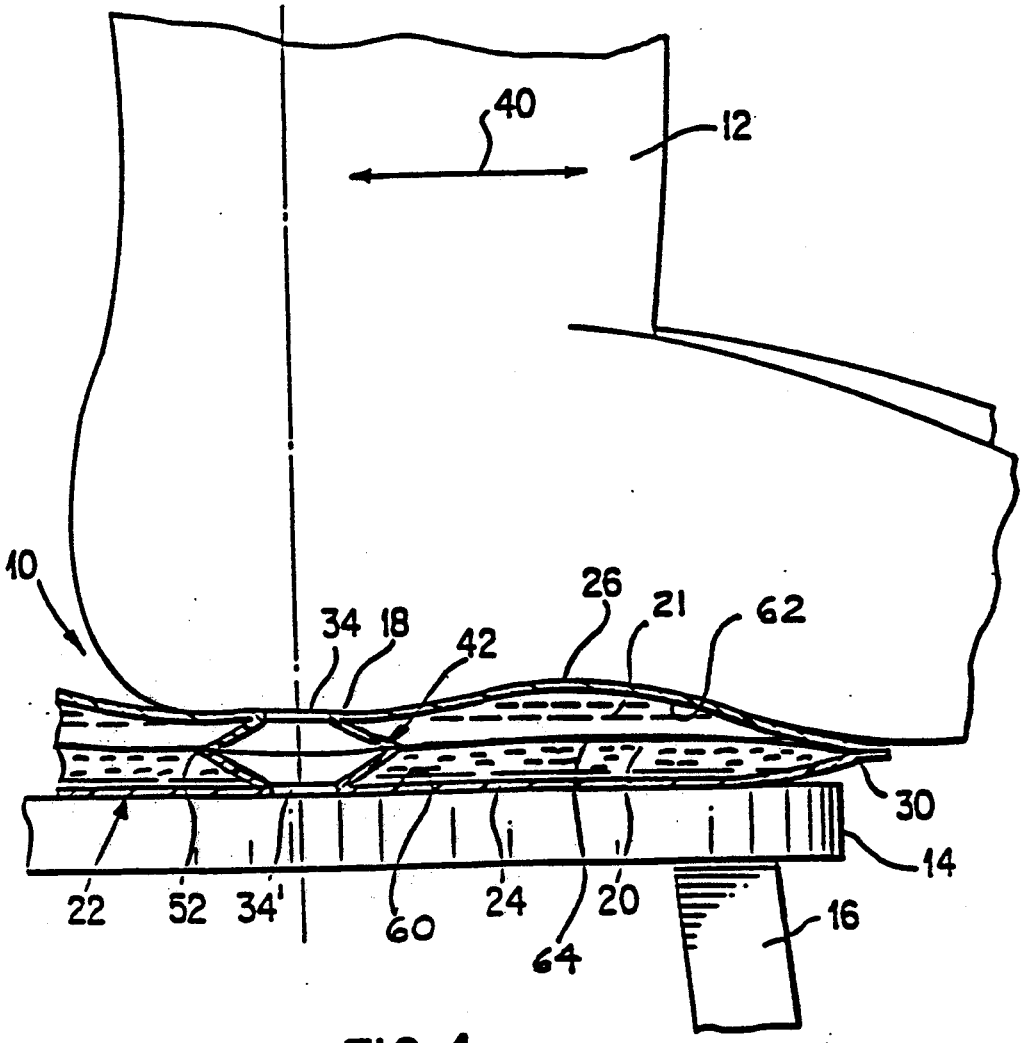
FIG. 4 is a sectional view of the fluid cushion partially cut-away taken along the section line 4—4 of FIG. 1; and, FIG. 5 is a partially cut-away view of an embodiment of the subject fluid cushion showing a wave damping mechanism contained within one of the fluid chambers of the overall fluid tight housing.

Referring now to FIGS. 1–4, there is shown fluid cushion 10 for relieving pressure on the body tissue (muscles, nerves and skin) in the are of the ischium of user or person 12 sitting thereon as is depicted in FIGS. 1 and 4. Fluid cushion 10 as herein described is an improvement of the fluid cushion described in U.S. Pat. No. 5,113,540 of which this is a continuation-in-part. Specifically, fluid cushion 10 of the subject invention provides for internal first and second chambers 62 and 60 containing fluid mediums to be further described in following paragraphs.

The specific overall geometry and contouring of fluid cushion 10 is of maximum importance to allow for distribution of forces applied to body 12 and allows the distribution of loading forces over a wider area at the points of contact 18 in order to reduce load stress and ultimately to relieve discomfort of user or person 12 during a prolonged sitting time interval.

The ischium of person 12 is one of three parts of the hip bone which joins the ilium and the pubis to form the acetabulum. Anatomically, the ischium comprises the dorsal portion of the hip bone and is divided into the body of the ischium which forms two-fifths of the acetabulum and the ramus which joins the inferior ramus of the pubis. The spine of the ischium provides attachment for a plurality of muscles such as the gemellus superior, the coccygeus, and the levitator ani. The greater sciatic notch above the spine transmits the superior and inferior gluteal vessels and various nerves such as the gluteal nerves, the sciatic nerve, and the nerves to the obturator internus and the quadratus femoris.

A notch below the spine of the ischium transmits various ligaments, vessels and nerves. The large dorsal tuberosity of the ischium provides attachment for various muscles such as the adductor longus, the semi-membranous, the biceps femoris, and the semi-tendinosus. The ischial spines are two relatively sharp bony projections into the pelvic outlet from the ischial bones that form the lower body of the pelvis.

Generally, a user or person 12 does not have a large amount of tissue between the ischial spines and the epidermis of the skin. When pressure builds from the outside such is applied to those bones. Thus, in some cases, the skin of person 12 breaks down over a prolonged pressure application and causes decubitus ulcers. Such ulcers result in discomfiture for persons 12 who are sitting for prolonged periods of time during which loads are applied as is shown in the Figures.

Fluid cushion 10 is adapted to be placed on base member 14 which may be the seat of a chair 16 or such may be another type of base member 14 not important to the inventive concept as herein described. Fluid cushion 10 is positionally located on base member 14 as shown in FIGS. 1 and 4 with the user's body being shown in phantom line drawing in FIG. 1. Fluid cushion 10 may be formed generally of a closed cell type of plastic composition such as polypropylene and further is resilient and flexible to allow deformation as user 12 applied pressure to an external surface of fluid cushion 10.

The particular composition of fluid cushion 10 is not important to the overall concept of the invention as herein described, with the exception that it must be fluid tight in order to maintain first and second fluid chamber fluid 21 and 20 therein with a resiliency to allow applied load deformation. Obviously, the particular thickness of the walls of fluid cushion 10 must be sufficient to maintain structural integrity throughout applied load use.

Fluid cushion 10 includes fluid tight closed housing 22 which is formed externally of upper surface member 24 and lower surface member 26 as is shown in FIGS. 3 and 4. Upper surface member 24 and lower surface member 26 define peripheral edge 28 passing around the perimeter of fluid cushion 10 as is shown in FIGS. 1 and 2. Upper and lower surface members 24 and 26 may be heat sealed at heat sealing sections 30 shown in FIGS. 3 and 4 adjacent peripheral edge 28. In this manner, housing 22 is formed into a closed contour, resilient and deformable housing for application of forces applied by user 12.

As is clearly seen in FIGS. 3 and 4, fluid cushion 10 further includes intermediate membrane member 64 defining an internal fluid tight housing first chamber 62 and an internal fluid tight housing second chamber 60. Each of said first and second chambers 62 and 60 are at least partially filled with respective first and second fluid mediums 21 and 20. Intermediate plastic membrane 64 is sealingly secured to peripheral edge 28 of housing 22 and is generally sandwiched between upper surface member 24 and lower surface member 26 as is seen in the Figures. Additionally, intermediate membrane 64 is sealingly attached to tubular mechanism 42 to be further described in following paragraphs. In this manner, intermediate plastic membrane 64 which is liquid impervious provides for respective first and second chambers 62 and 60 within housing 22.

It has been found that comfort of user 12 is maximized when fluid mediums 21 and 20 have differing viscosities with fluid medium 21 having a lower viscosity than fluid medium 20. First fluid medium 21 may be air or water with second fluid medium 20 being respectively a liquid of higher viscosity with respect to air such as water or when water is used for first chamber fluid medium then a gel like compostion may be used for second fluid medium 20.

Intermediate membrane 64 as has previously been described may be formed of a closed cell plastic type composition and one composition which has been found suitable for use is polypropylene, however, other types of flexible liquid impervious plastic compositions may be advantageously used in the manufacture of fluid cushion 10.

Tubular mechanism 42 is clearly seen to be secured to upper surface member 24 and lower surface member 26 as well as intermediate membrane member 64 in fluid tight relation. Tubular mechanism 42 defines at least one vertically directed through opening such as 32, 34 or 32', 34' defining respective through passages 44, 46 having tubular side wall members 50 of varying cross-sectional diameter when taken with respect to vertical direction 36.

As is clearly seen in FIGS. 1–4, each of upper and lower surface members 24 and 26 include a pair of upper surface member openings 32, 34 as well as a pair of lower surface member openings 32', 34', as is seen in FIG. 3. The pair of lower surface member openings 32', 34' are maintained in contiguous contact with base surface 14 when load is applied whereas openings 32, 34 of upper surface member 24 contiguously interface with the body of user 12.

In the non-loaded, undeformed state as is seen in FIGS. 2 and 3, upper surface member opening 32 is substantially vertically aligned in vertical direction 36 with lower surface member opening 32' and similarly upper surface member opening 34 is substantially vertically aligned with lower surface member opening 34'. It has been found that in order to relieve pressure on the ischium, the distance 38 between openings 32, 34 and 32', 34' are provided with particular dimensional sizing. The bones under consideration are inclined in longitudinal direction 40 and the bone interfaces narrow. Additionally, for different sized persons 12, distance 38 may be of differing value however it has been found that in order to obtain a placement for an average person 12, distance 38 should be in the range of approximately 4"–6". In this manner, there is placement in the transverse direction of the ischial bones which allows for substantial insert into or in the neighborhood of openings 32 and 34 formed through upper surface member 24.

Still further, due to the narrow bones under consideration and their longitudinal inclination, openings 32, 34 and 32', 34' are of particular dimension in the approximate diameter range of 1"–2".

The overall concept is to allow the inclined longitudinally extending bones to be inserted at least partially within openings 32 and 34 during the applied force loading. Particularly, openings 32, 34 and 32', 34' are preferably formed in an oval shape to allow greater surface area contact by the bones of user 12 in the depression formed during a deformation of fluid cushion 10. This obviously allows a greater surface area of the inclined longitudinally directed bones to impinge over a wider area during deformation and thus provides for a lower force on the bones of concern. For ease of construction, openings 32, 34 and 32', 34' may be formed in a circular contour which has also shown to provide advantageous results.

Figure 5:
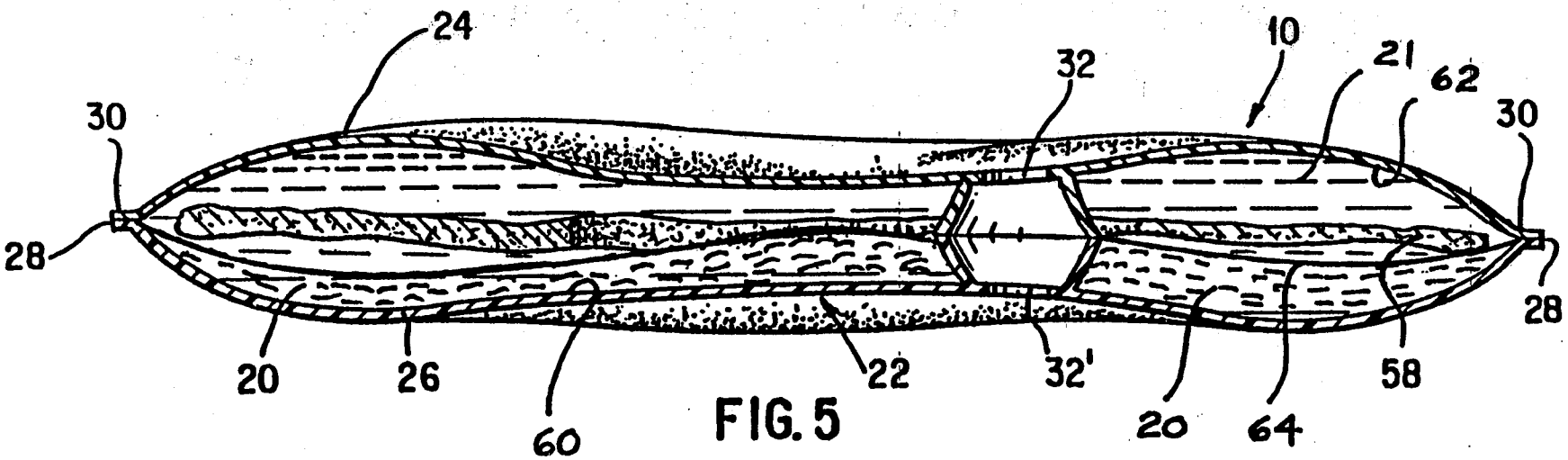

As has previously been referred to, FIGS. 3-5 clearly provide for tubular mechanism 42 for joining upper and lower surface members 24 and 26 in fluid tight relation. Additionally, tubular mechanisms 42 may be positionally located elsewhere such as in the rear center of fluid cushion 10 to relieve pressure under the coccyx or base of the spine as previously described. Tubular mechanism 42 is formed in one-piece formation with upper and lower surface members 24 and 26 in fluid tight relation to provide vertically directed through passages 44 and 46 as shown in FIG. 3. Tubular mechanisms 42 have a particular contouring as is shown in FIGS. 3-5 with the particular contour being of extreme importance in the operation of fluid cushion 10.

During development of fluid cushion 10, the dimensional constraints of openings 32, 32' and 34, 34' were of importance due to the average body construction of users 12. Dimensional constraints for the distance between openings 38 were somewhat constricted due to a rather low value and dimensional size of openings 32, 34 and 32', 34' which were also of a restricted size.

The relative close proximity of openings 32, 34 each to the other in combination with the relatively small diameters of openings 32 and 34 provided a condition not foreseen at the beginning of the development stage of the preparation of fluid cushion 10. Due to these relatively small distances 38, when person 12 applies pressure to upper surface member 24 of fluid cushion 10, base 48 between openings 32 and 34 would be substantially completely compressed into contiguous contact with base surface 14. This had the effect of not diminishing the discomfiture level of user 12.

It was found that providing a tubular mechanism 42 with pairs of sidewall members 50 of varying cross-sectional diameter when taken with respect to direction 36, that space 48 was not diminished to the extent previously known when tubular mechanism 42 was merely a tubular member of constant diameter.

In particular, tubular mechanism 44 defined by sidewall members 50 has a greater length than the vertical distance between openings 32 and 32' or 34 and 34' when fluid cushion 10 is in the undeformed state and upon compression there is a bulge formed providing apex 52 of sidewall members 50. The formation of sidewall members 50 in this type of configuration of a truncated cone as shown in FIGS. 3-5, allows for space 48 between respective openings to maintain a sufficient amount of liquid or fluid 21 and 20 within first and second chambers 62 and 60 upon any deformation to maintain a cushioning effect on the body of user 12.

Additionally, the space 48 which defines the volume between adjacent tubular mechanisms 42 is provided for both first chamber 62 and second chamber 60. A plastic membrane 64 is sealed to apex 52 of sidewalls 50 as is shown in a fluid tight relation. In this manner, two distinct fluid chambers 62 and 60 are formed each having respective fluid mediums 21 and 20 of differing viscosity as previously discussed.

Tubular mechanisms 42 take the form of flexible grommet members which couple and reinforce the structural integrity of fluid cushion 10 through securement to upper and lower surface members 24 and 26 as well as intermediate membrane member 64. The theoretical mechanism of sidewall members 50 of tubular mechanisms 42 having a diameter apex 52 greater than the diameter of openings 32 and 34 is not completely understood when taken with relation to the result to the result of maintaining fluid within spaces 48 of first and second chambers 62 and 60. However, the provision of this type of bulging contour may aid in the maintenance of fluids 20 and 21 within spaces 48 by providing a greater surface area of sidewalls 50 in contact with fluid in spaces 48 thus diminishing the pressure within spaces 48 and the maintenance of fluid therein when fluid cushion 10 is deformed as is shown in FIG. 4.

In this manner, a pair of internal chambers 62 and 60 are provided containing respective fluids 21 and 20 of differing viscosity wherein the fluids 21 and 20 are maintained in all sections of fluid cushion 10 even when load is applied through the body of the user 12. The concept of maintenance of fluid within the spaces 48 is an important result found from the fact of the particular contouring of tubular mechanism 42 and specifically sidewall members 50. Thus, tubular sidewall members 50 define a diameter apex 52 having a greater dimension than a diameter of upper and lower surface member openings 32, 34 and 32', 34' at a predetermined vertical position between upper and lower surface members 24 and 26 to achieve the aforementioned results.

In a preferred embodiment, it has been found that advantageous results have occurred when the diameter apex 52 is located substantially vertically mid-point of the vertical length of tubular sidewall members 50. Additionally, the tubular sidewall diameter in cross-section when taken with respect to vertical direction 36 varies substantially linearly and provides a truncated cone effect as is viewed for the cross-section shown in FIG. 3.

Referring now to FIG. 5, there is shown an embodiment of the subject invention concept including damping mechanism 58 for damping fluid waves produced by fluid medium 21 when force is applied to an external surface of fluid tight closed housing 22. As is seen in FIG. 5, damping mechanism 58 is positionally located within first chamber 62 however, damping mechanism 58 may be positionally located within second chamber 60.

Damping mechanism 58 may be a sponge-like material which absorbs a portion of fluid medium 21 at least partially filling first chamber 62 and further may be formed of an open cell type construction. Still further, damping mechanism 58 may be a resilient pad formed of an open cell plastic composition or in the alternative may be a fibrous type of composition such as nylon, to provide for a damping action when a dynamic load is imparted to fluid cushion 10 by user 12.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or the scope of the invention as defined in the appended claims.

What is claimed is:

1. A fluid cushion comprising:

(a) a fluid tight closed housing having an upper surface member, a lower surface member and an intermediate membrane member defining an internal fluid tight housing first chamber and an internal fluid tight housing second chamber, said first chamber having a first fluid medium contained therein and said second chamber having a second fluid medium contained therein, each of said upper and lower surfaces having at least two openings formed therethrough, said openings formed through said upper surface member being substantially vertically aligned with said openings formed through said lower surface member; and, (b) tubular means secured to said upper surface member, said lower surface member and said intermediate membrane member in fluid tight relation, said tubular means defining at least a pair of vertically directed through openings having tubular sidewall members of varying cross-sectional diameter when taken with respect to a vertical direction wherein said tubular sidewall members define an apex diameter having a greater dimension than a diameter of said vertically directed through openings formed through said upper and lower surface members, said tubular means being adapted to interface with a user's ischial spines.

2. The fluid cushion as recited in claim 1 where said tubular sidewall members apex diameter is positionally located substantially vertically midpoint of a vertical length of said tubular sidewall members.

3. The fluid cushion as recited in claim 1 where said tubular sidewall diameter varies substantially linearly when taken with respect to said vertical direction.

4. The fluid cushion as recited in claim 1 where said intermediate membrane member is sealed to a peripheral edge of said housing and to said tubular sidewall members.

5. The fluid cushion as recited in claim 4 where said intermediate membrane is formed of a liquid impervious closed cell plastic composition.

6. The fluid cushion as recited in claim 4 where said intermediate membrane is heat sealed to said peripheral edge of said housing and to said tubular sidewall members.

7. The fluid cushion as recited in claim 4 where said first and second chambers are at least partially filled with said first and second fluid mediums of differing viscosities.

8. The fluid cushion as recited in claim 7 where said second fluid medium has a greater viscosity than a viscosity of said first fluid medium.

9. The fluid cushion as recited in claim 1 where said tubular means includes a pair of tubular sidewall members defining a pair of vertically directed through openings.

10. The fluid cushion as recited in claim 9 where said pair of vertically directed through openings define respective vertically directed axes displaced each from the other by approximately 4.0 inches.

11. The fluid cushion as recited in claim 9 where said pair of vertically directed through openings define a diameter approximating 1.0 inches adjacent said upper and lower surface members.

12. The fluid cushion as recited in claim 1 where said tubular means includes a pair of flexible fluid impervious grommets secured to said housing upper and lower surface members defining a pair of through openings directed vertically through said fluid tight housing.

13. The fluid cushion as recited in claim 12 where each of said flexible fluid impervious grommets includes a tubular sidewall having a diameter at substantially a vertical mid-point of said grommet which is greater than a diameter of said grommet on vertically opposing ends thereof.

14. The fluid cushion as recited in claim 13 where said intermediate membrane is sealed to each of said grommets tubular sidewalls in fluid tight relation, said intermediate membrane being substantially at said vertical mid-point of each of said grommets.

15. The fluid cushion as recited in claim 1 including means for damping waves produced by said first and second fluid medium when a loading force is applied to an external surface of said fluid cushion.

16. The fluid cushion as recited in claim 15 where said means for damping waves includes a resilient member positionally located within one of said first and second chambers.

17. The fluid cushion as recited in claim 16 where said resilient member is at least partially fluid absorptive and is formed of an open cell plastic composition.

18. The fluid cushion as recited in claim 16 where said resilient member is formed of a fibrous material composition and is at least partially fluid absorptive.

19. The fluid cushion as recited in claim 1 where said upper and lower surface members are formed of a closed cell plastic composition.

20. The fluid cushion as recited in claim 1 where said first fluid medium is a gel composition.

21. The fluid cushion as recited in claim 1 where said second fluid medium is a gel composition.

* * * * *